US005240821A

United States Patent [19]

Texter et al.

[11] Patent Number: 5,240,821

[45] Date of Patent: Aug. 31, 1993

[54] SOLID PARTICLE DISPERSION DEVELOPER PRECURSORS FOR PHOTOGRAPHIC ELEMENTS

[75] Inventors: John Texter, Rochester; William B. Travis, Bloomfield; Jared B. Mooberry, Rochester, all of N.Y.

[73] Assignee: Eastman Kodak Company, Rochester, N.Y.

[21] Appl. No.: 810,232

[22] Filed: Dec. 19, 1991

[51] Int. Cl.[5] ..... G03C 1/005; G03C 7/305; G03C 7/388

[52] U.S. Cl. ..... 430/405; 430/566; 430/959; 430/44.3; 430/377; 430/546

[58] Field of Search ..... 430/405, 959, 566, 443, 430/943, 373, 461, 373, 546

[56] References Cited

U.S. PATENT DOCUMENTS

| | | | |
|---|---|---|---|
| 3,674,478 | 7/1972 | Grasshoff et al. | 430/219 |
| 3,993,661 | 11/1976 | Grafhoff et al. | 548/251 |
| 4,045,225 | 8/1977 | Shimamura et al. | 430/373 |
| 4,157,915 | 6/1979 | Hamaoka et al. | 430/505 |
| 4,294,916 | 10/1981 | Postle et al. | 430/522 |
| 4,294,917 | 10/1981 | Postle et al. | 430/522 |
| 4,371,609 | 2/1983 | Kajiwara et al. | 430/373 |
| 4,469,780 | 9/1984 | Hirai et al. | 430/373 |
| 4,474,872 | 10/1984 | Onishi et al. | 430/566 |
| 4,526,860 | 7/1985 | Kitchin | 430/373 |
| 4,948,718 | 8/1990 | Factor et al. | 430/522 |
| 5,019,492 | 5/1991 | Buchanan et al. | 430/543 |
| 5,043,254 | 8/1991 | Nakagawa et al. | 430/405 |

FOREIGN PATENT DOCUMENTS

| | | |
|---|---|---|
| 0099861 | 2/1984 | European Pat. Off. . |
| 0353629 | 2/1990 | European Pat. Off. . |
| 61-77851 | 4/1986 | Japan . |
| 1570362 | 7/1980 | United Kingdom . |

OTHER PUBLICATIONS

Japan Patent Abstract, vol. 015153, Shigeru "*Silver Halide Photographic Sensitive Material*", 01/1991, #3023441.

*Primary Examiner*—Charles L. Bowers, Jr.
*Assistant Examiner*—Mark F. Huff
*Attorney, Agent, or Firm*—Foley & Lardner

[57] ABSTRACT

A dispersion comprising solid particles of a developer precursor having the structure $$CD-(T)_m-S$$

in which

CD is a silver halide color developer,
T is a timing group,
m is an integer from 0 to 6, and
S is a blocking group, and a vehicle in which the solid particles are insoluble, is disclosed. The dispersion can be incorporated in a photographic element.

33 Claims, No Drawings

SOLID PARTICLE DISPERSION DEVELOPER PRECURSORS FOR PHOTOGRAPHIC ELEMENTS

BACKGROUND OF THE INVENTION

This invention pertains to photographic developers, and in particular to novel photographic developer precursors in the form of solid particles in a dispersion.

Many photographic product and process improvements and beneficial new photographic products and processes could be made available with the introduction of suitable silver halide color forming developers, which can be dispersed with the silver halide at the time of manufacture of the respective photographic element. It is well known in the art that the introduction of conventional color developers, such as p-aminophenols, into sensitized photographic elements containing silver halide salts, leads to desensitization of the silver halide emulsion and unsuitable fog in such layers. Much effort has therefore been directed at trying to produce effective blocked developers, which can be introduced in silver halide emulsion elements without deleterious desensitization or fog effects and which unblock chemically under conditions of development so that developer is free to participate in color forming (dye forming) reactions.

U.S. Pat. No. 3,342,599, to Reeves, discloses the use of Schiff base developer precursors. Schleigh and Faul, in a Research Disclosure (129 (1975) pp. 27–30), described the quaternary blocking of color developer and the acetamido blocking of p-phenylenediamines. Subsequently, U.S. Pat. No. 4,157,915, to Hamaoka et al., and U.S. Pat. No. 4,060,418, to Waxman and Mourning, describe the preparation and use of carbamate blocked p-phenylenediamines.

All of these approaches and inventions have failed in practical product applications because of one or more of the following problems: desensitization of sensitized silver halide; unacceptably slow unblocking kinetics; thermal instability of blocked developer yielding increased fog and/or decreased Dmax after storage.

Recent developments in blocking and switching chemistry have led to blocked p-phenylenediamines that perform reasonably well. In particular, compounds having "β-ketoester" (strictly, β-ketoacyl) blocking groups are described in U.S. Pat. No. 5,019,492. The incorporation of blocked developers in photographic elements is carried out using colloidal gelatin dispersions of the blocked developers. These dispersions are prepared using means well known in the art, wherein the developer precursor is dissolved in a high vapor pressure organic solvent (for example, ethyl acetate), along with, in some cases, a low vapor pressure organic solvent (such as dibutylphthalate), and then emulsified with an aqueous surfactant gelatin solution. After emulsification, usually done with a colloid mill, the high vapor pressure organic solvent is removed by evaporation or by washing, as is well known in the art.

Certain examples of these new classes of blocked developers exhibit one or more of the following problems, however. For instance, during emulsification, the developer precursor can crystallize and phase-separate from the oil phase of the emulsion, where such crystallites are sufficiently large (greater than 1 μm in largest dimension) to give deleterious coating properties and insufficient dye-forming activity. After emulsification during removal of the high vapor pressure organic solvent, the developer precursors can crystallize, undergoing a phase transformation, leading to large crystallites (greater than 1 μm in largest dimension), poor coating quality, and poor unblocking and dye-forming activity. After the developer precursor dispersions are coated in a photographic element, upon storage at moderate humidity and temperature, or at high humidity and temperature, the developer precursors can aggregate and form large crystallites (greater than 1 μm in largest dimension) by molecularly diffusing through the gelatin binder, leading to unacceptably low unblocking activity. During the emulsification procedure, at the elevated temperatures commonly encountered, partial thermal decomposition of the developer precursor can occur, leading to wasteful destruction of the developer precursors, to decreased dye-forming activity, and to deleterious sensitization effects on the silver halide emulsion. Finally, after coating in a sensitized silver halide photographic element, and during storage at moderate humidity and temperature or at elevated humidity and temperature, partial thermal decomposition of the developer precursor can occur, leading to loss of precursor and subsequently to a loss in dye-forming activity, and to deleterious sensitization effects from the decomposition products.

Processes that produce submicron solid particle colloids have found advantageous use in producing dispersions of photographically useful chemicals such as visible-region filter dyes, sensitizing dyes, etc. U.S. Pat. Nos. 4,294,916 and 4,294,917, to Postle et al., describe solid dispersions of photographic filter dyes and offer the advantage that such dyes in the solid state give broad spectral absorption. The preparation and use of apparently solid particle dispersions of spectrally sensitizing dyes is disclosed in German Patent No. 1,547,705. A process for producing solid particle dispersions using sand, bead, dyno, and Masap mills, and using mills described in U.S. Pat. Nos. 2,581,414 and 2,855,156, is disclosed in British Patent No. 1,570,362. The inventors of the British patent state that non-diffusing, slightly soluble color couplers can be dispersed by the milling process described. DIR (development inhibitor releasing) couplers, spectral sensitizing dyes, and photographic stabilizers are examples of other photographically useful materials that the British patent states may be dispersed as solid particle milled dispersions. There is, however, no teaching available to indicate that photographic color-forming developers may be dispersed as solid particle dispersions.

A need has existed for a photographic developer that avoids the problems described above. In particular, it would be desirable to provide such a developer in the form of a dispersion. It would also be desirable to provide a method for developing an image using the dispersion, and a photographic element including the dispersion.

SUMMARY OF THE INVENTION

These needs have been satisfied by providing a dispersion comprising solid particles of a developer precursor having a structure according to the formula (I):

$$CD-(T)_m-S \qquad (I)$$

in which

CD is a silver halide color developer,

T is a timing group, m is an integer from 0 to 6 and denotes the number of timing groups connected in series, and S is a blocking group, and a vehicle in which the solid particles are insoluble.

There are also provided photographic elements comprising a dispersion as described above.

Additionally, there is provided a process for developing an image in a photographic element comprising a support, a silver halide emulsion containing an imagewise distribution of developable silver halide grains, and a dispersion as described above, comprising the step of contacting the element with a processing solution comprising a nucleophile, at a pH sufficient for the solid particles of the precursor to become soluble.

Furthermore, there is provided a process for incorporating a developer precursor into a photographic element which comprises the steps of dispersing the solid particles of the above-described developer precursor in a vehicle in which the solid particles are insoluble to produce a dispersion, and incorporating the dispersion in the photographic element.

DETAILED DESCRIPTION OF THE INVENTION

It has now been discovered that a broad class of developer precursors, chosen so that the developer precursor and its substituents meet a specific combination of solubility criteria (for example, insolubility at milling and coating pH), can be prepared as solid particle dispersions which obviate one or more of the above described problems. (Related inventions and embodiments are described in U.S. patent application Ser. Nos. 07/810,241, 07/810,322 and 07/810,944, filed simultaneously herewith.)

The timing group(s), T, can contain one or more substituents to control the aqueous solubility of the precursor compound. Exemplary timing groups are disclosed in U.S. Pat. Nos. 4,248,962, 4,772,537 and 5,019,492. Up to six timing groups can be joined sequentially according to the invention (that is, m=0 to 6). Preferably, m=0, 1 or 2.

The blocking group S must have appropriate hydrolysis kinetics, that is, it must be a group that completely unblocks in the course of the development process. The blocking group S can be, for example, an acyl group, in particular a $\beta$-ketoacyl group as described in U.S. Pat. No. 5,019,492, which is hereby incorporated by reference. Exemplary preferred groups include:

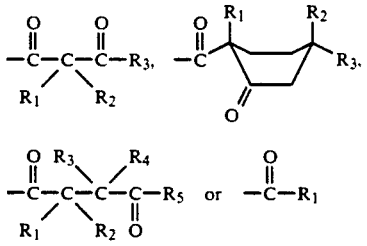

in which $R_1$, $R_2$, $R_3$, $R_4$ and $R_5$ individually are H or an alkyl group having 1 to 20 carbon atoms, and preferably are H or methyl. The group S can also contain one or more substituents to control the aqueous solubility of the developer precursor.

Both the timing and blocking groups can be unballasted or ballasted. In other words, at least one of T and S can include a group of such molecular size and configuration as to render the present compound nondiffusible as described, for example, in U.S. Pat. Nos. 4,420,556 and 4,923,789. Advantageous ballast groups include alkyl and aryl groups having from about 8 to 32 carbon atoms.

The color developer, CD, may contain one or more substituents to control the aqueous and/or oil solubility of the developer precursor. These substituents are well known to those skilled in the art, and include, for example, alkyl, hydroxyalkyl, sulfonamidoalkyl, sulfoalkyl, sulfo and carboxyalkyl.

The precursor dispersions according to the invention are substantially insoluble in water at pH 6 or below, substantially non-wandering in a photographic element, and substantially soluble in aqueous solution at pH 9 or above. The precursor dispersions of the invention are coatable in hydrophilic vehicle layers (for example, gelatin layers) of photographic elements and do not wander at the normal coating pH of 3 to 6. At normal photographic processing pH of 9 to 14, the precursors become adequately soluble, allowing then to undergo the requisite blocking chemistry and timing group reactions.

The silver halide color developer CD preferably is of the p-phenylenediamine or p-aminophenol type. Preferred developer precursors, according to the invention, are given below in Table I. These developer precursors according to the invention are prepared by well-known techniques, such as those described in U.S. Pat. No. 5,019,492, and also those described in U.S. patent application Ser. Nos. 07/700,006, 07/810,241 and 07/810,322 as well as in U.S. Pat. No. 3,342,599, U.S. Pat. No. 4,060,418, and U.S. Pat. No. 4,157,915, the disclosures of each of which are hereby incorporated in their entireties by reference.

The developer precursor compounds include those of the p-phenylenediamine type described in Table I, and in addition include analogous aminophenol compounds. The aminophenol compounds have structures according to the following formulas:

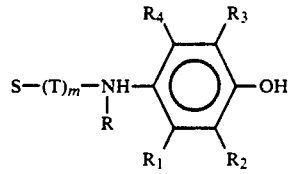

and

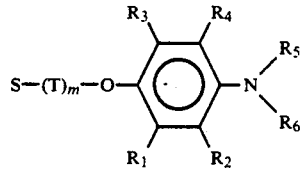

where S, T and m are as defined above. Here, R, $R_1$, $R_2$, $R_3$, $R_4$, $R_5$ and $R_6$ are independently H, halogen, alkyl, alkoxy, alkylsulfonamido, acylamido or aryl. Specific examples of such blocked aminophenols are listed in Table II.

Other blocked p-phenylenediamines of this invention include carbamate, oxamide, urea, thiourea, trihaloacetamido, perfluoroacyl, hydroxamic acid, and Schiff base derivatives. Examples of such blocked p-phenylenediamines are listed in Table III.

TABLE I
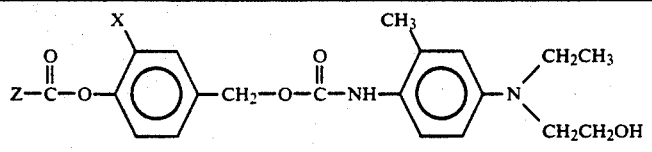
| | Z | X |
|---|---|---|
| 1 | $-C(CH_3)_2-CO-CH_3$ | $-NHSO_2CH_3$ |
| 2 | $-C(CH_3)_2-CO-CH_3$ | $-NHSO_2CH_2(CH_2)_{14}CH_3$ |
| 3 | $-C(CH_3)_2-CO-CH_3$ | $-H$ |
| 4 | $-C(CH_3)_2-CO-CH_3$ | $-NH-CO-(CH_2)_3CO_2C(CH_3)_3$ |
| 5 | $-C(CH_3)_2-CO-CH_3$ | $-NH-CO-(CH_2)_3CO_2H$ |
| 6 | 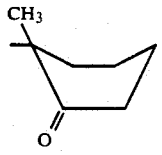 | $-NHSO_2CH_3$ |
| 7 | $-CH(CH_3)_2$ | $-H$ |
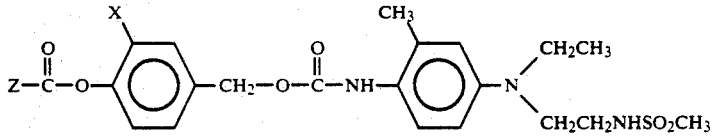
| | Z | X |
|---|---|---|
| 8 | $-C(CH_3)_2-CO-CH_3$ | $-NHSO_2CH_3$ |
| 9 | $-CH(CH_3)_3$ | $-NHSO_2CH_3$ |
| 10 | 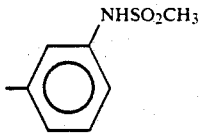 | $-H$ |
| 11 | $-CH(CH_3)_2$ | $-NHCO(CH_2)_3CO_2H$ |
| 12 | $-CH(CH_3)_2$ | $-NHSO_2CH_3$ |
| 13 | $-CH_2CH_3$ | $-NHCO(CH_2)_3CO_2H$ |
| 14 | 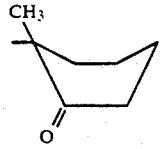 | $-NHCO(CH_2)_3CO_2H$ |
| 15 | $-CH_2CH_3$ | 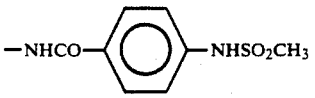 |
| 16 | 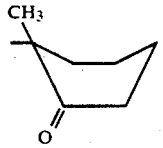 | 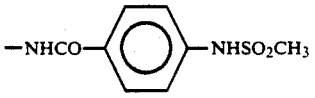 |
| 17 | 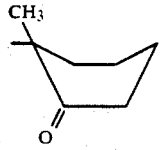 | $-NHSO_2CH_3$ |

TABLE I-continued
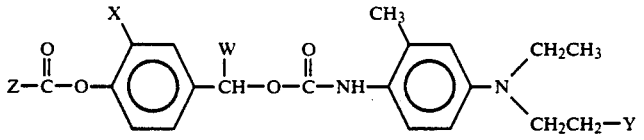
| | W | Z | Y | X |
|---|---|---|---|---|
| 18 | —H | —$CH_2CH_3$ | —$NHSO_2CH_3$ | 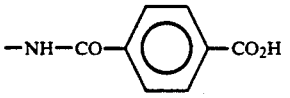 |
| 19 | —H | —$CH_2CH_3$ | —OH | 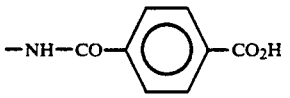 |
| 20 | —H | —$CH_2CH_3$ | —H | 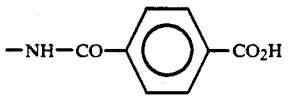 |
| 21 | —H | —$CH_3$ | —$NHSO_2CH_3$ | 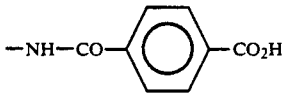 |
| 22 | —H | —$CH_2CH_2CH_3$ | —$NHSO_2CH_3$ | 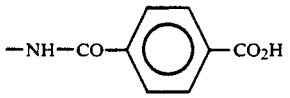 |
| 23 | —H | —$CH(CH_3)_2$ | —$NHSO_2CH_3$ | 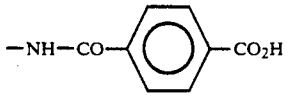 |
| 24 | —H | —$CH_2CH_3$ | —$NHSO_2CH_3$ | 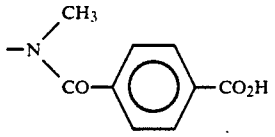 |
| 25 | —H | —$CH_2CH_3$ | —$NHSO_2CH_3$ | 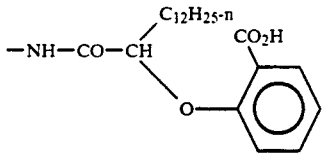 |
| 26 | —$CH_3$ | —$CH_2CH_3$ | —$NHSO_2CH_3$ | 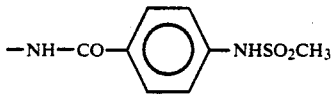 |
| 27 | —H | 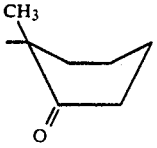 | —$NHSO_2CH_3$ | 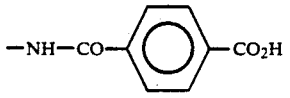 |

TABLE II
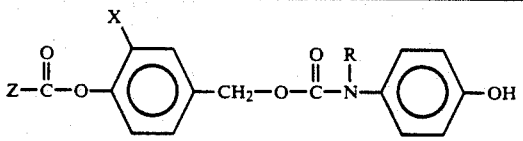
| | Z | X | R |
|---|---|---|---|
| 28 | $-C(CH_3)_2-CO-CH_3$ | $-NHSO_2CH_3$ | $-CH_2CH_3$ |
| 29 | $-C(CH_3)_2-CO-CH_3$ | $-NH-CO-(CH_2)_3CO_2H$ | $-CH_2CH_3$ |
| 30 | $-C(CH_3)_2-CO-CH_3$ | 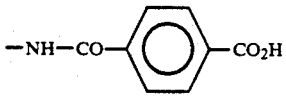 | $-CH_3$ |
| 31 | 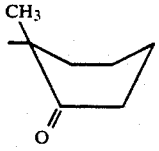 | 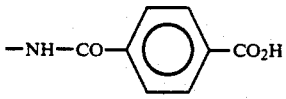 | $-CH_3$ |
| 32 | $-CH_2CH_3$ | 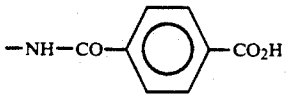 | $-CH_3$ |
| 33 | $-CH(CH_3)_2$ | $-NHSO_2CH_3$ | $-CH_2CH_3$ |
| 34 | $-CH(CH_3)_2$ | 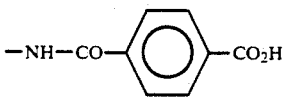 | $-CH_3$ |
| 35 | $-CH(CH_2)_3$ | 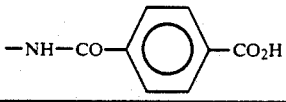 | $-H$ |
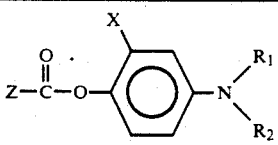
| | Z | X | $R_1$ | $R_2$ |
|---|---|---|---|---|
| 36 | $-CH_3$ | $-O-CH_3$ | $-CH_2CH_3$ | $-CH_2CH_3$ |
| 37 | $-CH(CH_3)_2$ | $-H$ | $-CH_2CH_2OH$ | $-CH_2CH_3$ |
| 38 | $-CH_2CH_3$ | $-NHSO_2CH_3$ | $-CH_3$ | $-CH_3$ |
| 39 | $-CH_2CH_3$ | $-H$ | $-CH_2CH_3$ | $-CH_2CH_3$ |
TABLE III
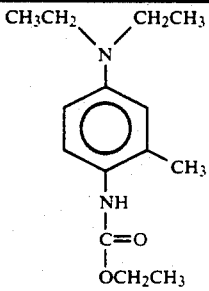
TABLE III-continued
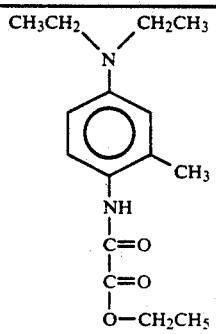

TABLE III-continued
42
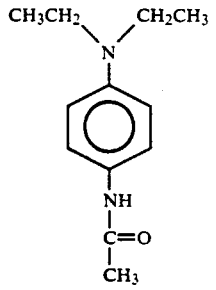
43
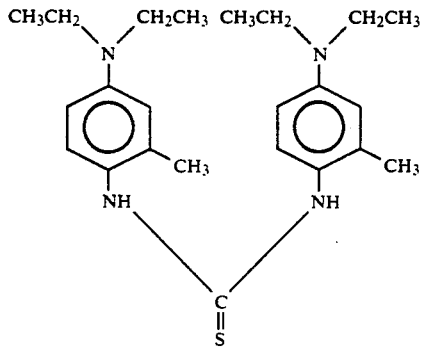
44
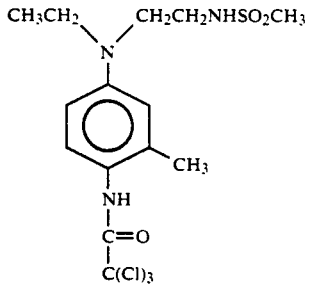
45
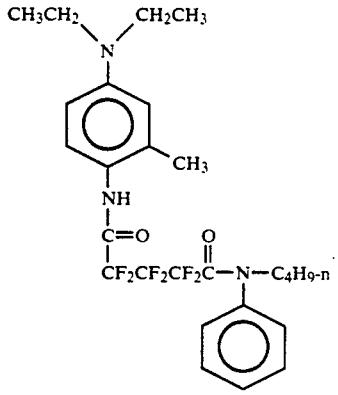
TABLE III-continued
46
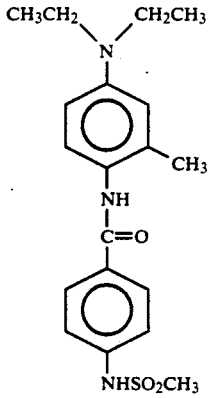
47
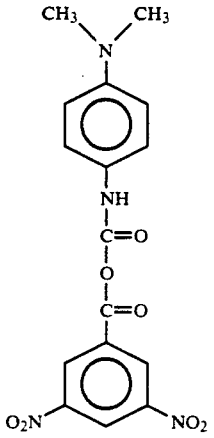
48
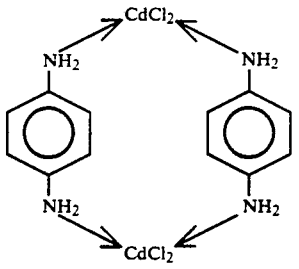
49
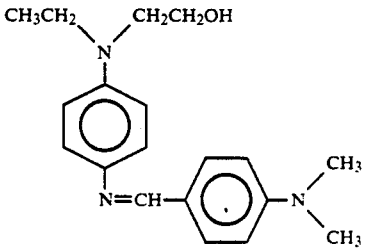

TABLE III-continued

50 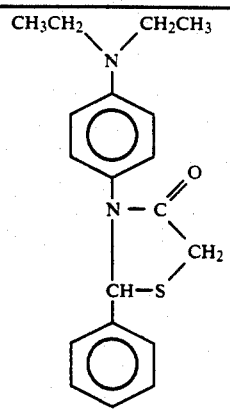

51 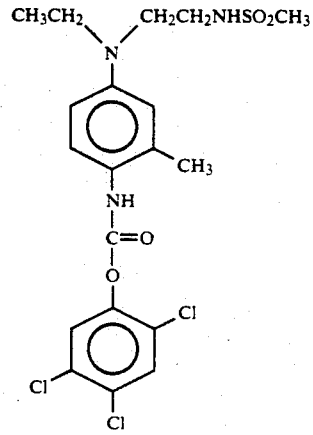

52 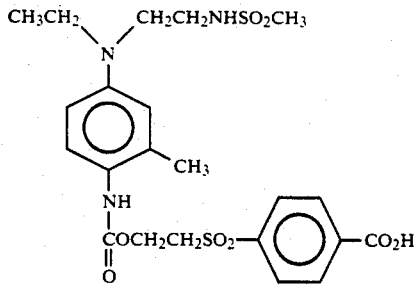

53 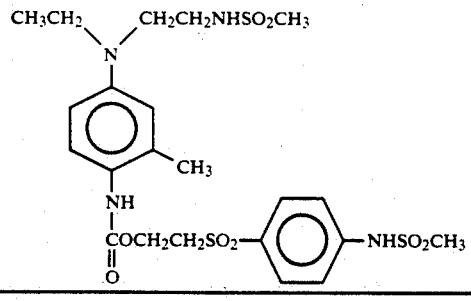

The developer precursor compounds of formula I are used in the form of a solid particle dispersion, where the compounds are in the form of solid particles of microscopic size less than about 10 μm in largest dimension. The dispersion vehicle can be any vehicle in which the developer precursor is not soluble, such as an aqueous liquid having a pH low enough for the developer precursor to be insoluble, an organic solvent in which the developer precursor is insoluble, a monomer, or a polymeric binder. An example of such a vehicle is a gelatin coating solution. The dispersion is useful for incorporation into a layer having a polymeric film-forming binder known in the art, such as a hydrophilic colloid binder in a photographic element.

Incorporation of developer precursor compounds as a solid particle dispersion, as defined herein, has a number of advantages over prior known methods of incorporation such as loaded polymer latexes, oil-in-water dispersions using a high-boiling water-immiscible solvent, and precipitation techniques that result in formation of large particles, where the largest dimension is greater than about 10 μm. These prior art methods can lead to a number of problems, such as poor thermal stability, poor dye-forming activity, poor coatability, emulsion desensitization, and unwanted fog.

The developer precursors may be located in any layer of the photographic element that is accessible by diffusion to a sensitized layer or layers containing silver salts (such as silver halide). It is particularly advantageous to locate them in layers where they will readily contact processing fluid during the development process. Useful amounts of developer precursor range from about 10 to 5000 mg/ml. The developer precursor should be present in an amount to yield an optical density of at least about 0.10 density units at the transmission Dmax or at the reflectance Dmax.

The solid particle dispersion can be formed by techniques well known in the art. These techniques include precipitating or reprecipitating the developer precursor in the form of a dispersion, and/or milling techniques, such as ball-milling, sand-milling, or media-milling the solid developer precursor in the presence of a dispersing agent. Reprecipitation techniques, such as dissolving the developer precursor and precipitating by changing the solvent and/or the pH of the solution in the presence of a surfactant, are well-known in the art. Milling techniques are well-known in the art and are described, for example, in U.S. Pat. No. 4,006,025. The developer precursor particles in the dispersion should have a largest dimension less than about 10 μm and preferably less than about 1 μm. The developer precursor particles can be conveniently prepared in sizes ranging down to about 0.001 μm or less.

In the following discussion of suitable materials for use in the emulsions and elements according to the invention, reference will be made to *Research Disclosure*, December 1989, Item 308119, published by Kenneth Mason Publications Ltd., Emsworth, Hampshire PO10 7DQ, U.K., the disclosures of which are incorporated in their entireties herein by reference. This publication will be identified hereafter as "Research Disclosure".

The support of the element of the invention can be any of a number of well known supports for photographic elements. These include polymeric films, such as cellulose esters (for example, cellulose triacetate and diacetate) and polyesters of dibasic aromatic carboxylic acids with divalent alcohols (such as polyethylene terephthalate), paper, and polymer-coated paper.

The photographic elements according to the invention can be coated on the selected supports as described in Research Disclosure Section XVII and the references cited therein.

The radiation-sensitive layer of a photographic element according to the invention can contain any of the known radiation-sensitive materials, such as silver halide, or other light sensitive silver salts. Silver halide is preferred as a radiation-sensitive material. Silver halide emulsions can contain, for example, silver bromide, silver chloride, silver iodide, silver chlorobromide, silver chloroiodide, silver bromoiodide, or mixtures thereof. The emulsions can include coarse, medium, or fine silver halide grains bounded by 100, 111, or 110 crystal planes.

The silver halide emulsions employed in the elements according to the invention can be either negative-working or positive-working. Suitable emulsions and their preparation are described in Research Disclosure Sections I and II and the publications cited therein.

Also useful are tabular grain silver halide emulsions. In general, tabular grain emulsions are those in which greater than 50 percent of the total grain projected area comprises tabular grain silver halide crystals having a grain diameter and thickness selected so that the diameter divided by the mathematical square of the thickness is greater than 25, wherein the diameter and thickness are both measured in microns. An example of tabular grain emulsions is described in U.S. Pat. No. 4,439,520.

Suitable vehicles for the emulsion layers and other layers of elements according to the invention are described in Research Disclosure Section IX and the publications cited therein.

The radiation-sensitive materials described above can be sensitized to a particular wavelength range of radiation, such as the red, blue, or green portions of the visible spectrum, or to other wavelength ranges, such as ultraviolet, infrared, X-ray, and the like. Sensitization of silver halide can be accomplished with chemical sensitizers such as gold compounds, iridium compounds, or other group VIII metal compounds, or with spectral sensitizing dyes such as cyanine dyes, merocyanine dyes, or other known spectral sensitizers. Exemplary sensitizers are described in Research Disclosure Section IV and the publications cited therein.

Multicolor photographic elements according to the invention generally comprise a blue-sensitive silver halide layer having a yellow color-forming coupler associated therewith, a green-sensitive layer having a magenta color-forming coupler associated therewith, and a red-sensitive silver halide layer having a cyan color-forming coupler associated therewith. Color photographic elements and color-forming couplers are well-known in the art. The elements according to the invention can include couplers as described in Research Disclosure Section VII, paragraphs D, E, F and G and the publications cited therein. These couplers can be incorporated in the elements and emulsions as described in Research Disclosure Section VII, paragraph C and the publications cited therein.

A photographic element according to the invention, or individual layers thereof, can also include any of a number of other well-known additives and layers. These include, for example, optical brighteners (see Research Disclosure Section V), antifoggants and image stabilizers (see Research Disclosure Section VI), light-absorbing materials such as filter layers of intergrain absorbers, and light-scattering materials (see Research Disclosure Section VIII), gelatin hardeners (see Research Disclosure Section X), oxidized developer scavengers, coating aids and various surfactants, overcoat layers, interlayers, barrier layers and antihalation layers (see Research Disclosure Section VII, paragraph K), antistatic agents (see Research Disclosure Section XIII), plasticizers and lubricants (see Research Disclosure Section XII), matting agents (see Research Disclosure Section XVI), antistain agents and image dye stabilizers (see Research Disclosure Section VII, paragraphs I and J), development-inhibitor releasing couplers and bleach accelerator-releasing couplers (see Research Disclosure Section VII, paragraph F), development modifiers (see Research Disclosure Section XXI), and other additives and layers known in the art.

Photographic elements according to the invention can be exposed to actinic radiation, typically in the visible region of the spectrum, to form a latent image as described in Research Disclosure Section XVIII, and then processed to form a visible dye image as described in Research Disclosure Section XIX. During processing, the developer precursor compound of formula I will generally be solubilized and undergo a sequence of reactions to release the color developer. Processing can be any type of known photographic processing, although it is preferably carried out at pH 9 to 14 and includes a nucleophile such as hydrogen peroxide, hydroxylamine, perborate, an alkyl peroxide, an aryl peroxide, or compound releasing such nucleophiles. When S is a $\beta$-ketoacyl group, the nucleophile is a dinucleophile, as discussed in U.S. Pat. No. 5,019,492.

A negative image can be developed by color development using one or more of the aforementioned nucleophiles. A positive image can be developed by first developing with a nonchromogenic developer, then uniformly fogging the element, and then developing by a process employing one or more of the aforementioned nucleophiles. If the material does not contain a color-forming coupler compound, dye images can be produced by incorporating a coupler in the developer solutions.

Development is followed by the conventional steps of bleaching, fixing, or bleach-fixing, to remove silver and silver halide, washing and drying. Bleaching and fixing can be performed with any of the materials known to be used for that purpose. Bleach baths generally comprise an aqueous solution of an oxidizing agent such as water soluble salts and complexes of iron (III) (such as potassium ferricyanide, ferric chloride, ammonium or potassium salts of ferric ethylenediaminetetraacetic acid), water-soluble dichromates (such as potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thioureas, and the like.

The solid particle dispersions according to the invention have numerous advantages. The use of microcrystalline dispersions of the developer precursors, prepared by ball-milling, sand-milling, media-milling, etc., produces particles of small size and eliminates any significant driving force for growth in particle size. The practice of the invention to produce fine particle dispersions of the compounds of this invention results in minimized scattering of light when the inventive dispersions are incorporated in photographic elements. Moreover, the inventive dispersions are more active with respect to dye formation than are crystallized dispersions that derive from by conventional oil-in-water emulsification procedures. The dispersions also have sufficient dye forming activity and, because of the microcrystalline physical state of the compounds in the dispersion particles, have enhanced thermal stability imparted by virtue of being in large part vibrationally constrained in a crystalline lattice.

The invention is further illustrated by the following examples, without being limited thereby.

EXAMPLES 1-3

A) Synthesis of Compound 15

The synthesis is illustrated in the following reaction scheme:

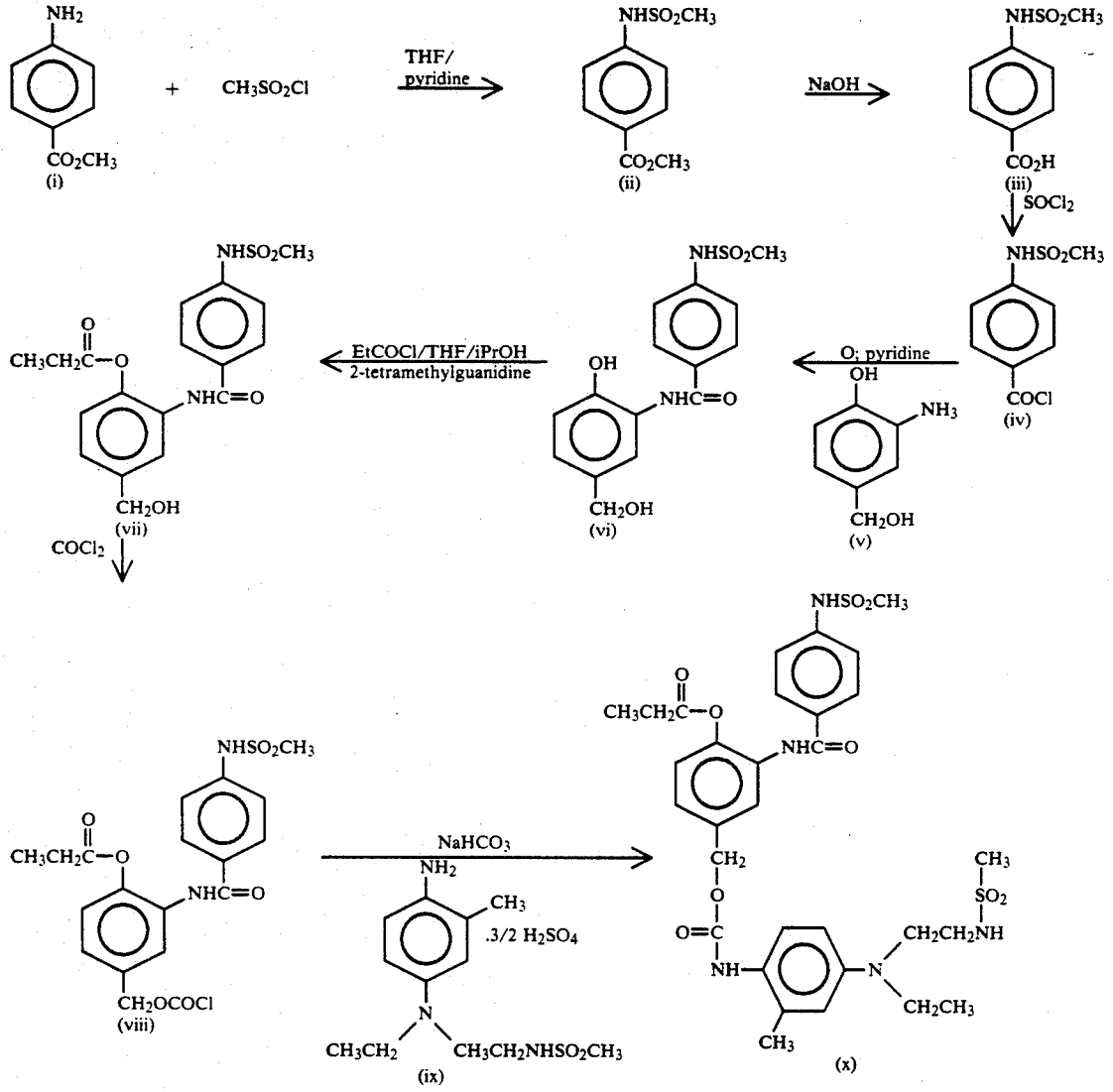

Commercially available methyl p-aminobenzoate (i)(46.8 g, 0.31 mole) was dissolved in a mixture of THF (150 ml) and pyridine (60 ml). The mixture was cooled in ice before adding methanesulfonyl chloride (24.2 ml, 0.31 mol, in 30 ml THF) slowly over 5 minutes. After stirring for about 20 minutes, the mixture was made acidic with excess 1N HCl and saturated NaCl. Product was obtained by extraction with ethyl acetate, drying over $MgSCO_4$, and concentration in a rotary evaporator to a solid. Ester (ii) (45 g) was obtained by slurrying this solid in heptane and filtering. Saponification of this ester (56.8 g, 0.25 mole) with NaOH (96 g of a 50% aqueous solution) in 240 ml of water at 50° C. was complete in about 10 minutes. Acidification with aqueous HCl precipitated carboxylic acid (iii), which was filtered, washed with water, and air dried to yield 42 g.

The carboxylic acid of the formula (iii) (54.7 g, 0.254 mole) was refluxed in a mixture of methylene chloride (335 ml), thionyl chloride (335 ml) and dimethylformamide (1 ml) for one hour. Solvents were distilled off under vacuum and residual thionyl chloride was chased with 500 ml of methylene chloride. The solid residue was slurried in 1:1 mixture of heptane:methylene chloride, filtered, redissolved in THF, refiltered, and air dried to solid acid chloride (iv) (59.3 g).

3-Amino-4-hydroxybenzyl alcohol (v) (14.4 g., 0.104 mole), prepared by reduction of the corresponding nitro alcohol, as described in U.S. Pat. No. 4,840,884, was completely dissolved in pyridine (90 ml) in a 500 ml round bottomed flask fitted with addition funnel, thermometer, and mechanical stirrer. After cooling in ice, the mixture was treated with a solution of acid chloride (iv) (24.3 g, 0.104 mole) in about 60 ml of THF, dropwise over about 10 minutes. The mixture was then allowed to warm slowly to room temperature over 45 minutes before diluting with excess aqueous HCl to precipitate the product. It was filtered, washed with water, and air dried to yield 29.5 g of amide (vi) (12 g, 0.0357 mole). Amide (vi) was dissolved in a mixture of isopropanol (150 ml) and tetramethylguanidine (8.2 g, 0.071 mole), cooled in a ice bath, and treated with propionyl chloride (3.1 ml, 0.0357 mole) in about 10 ml of THF, dropwise over a few minutes before allowing the mixture to stir for 20 minutes. The mixture was diluted with 100 ml of saturated NaCl, 70 ml of water, and 30 ml of 2N HCl before extracting the ester into ethyl acetate. The extracts were concentrated to yield crystalline solid (vii) (10.5 g, 0.0268 mole). All of ester (vii) was stirred at room temperature with a mixture of THF (50 ml), methylene chloride (50 ml), and phosgene (62 ml of 1.6M solution in toluene, 0.1 mole) for 4 hours. The mixture was then concentrated at 35° C. under vacuum to yield white solid chloroformate (viii) which was used immediately.

Color developer (ix) (17.4 g, 0.024 mole), sodium bicarbonate (13.4 g, 0.04 mole), methylene chloride (80 ml), and water (1000 ml) were combined in a round bottomed flask cooled in ice and stirred vigorously until all the solids were dissolved (gas evolution). All of chloroformate (viii) (0.027 mole) was added. The mixture was stirred vigorously for 10 minutes and then allowed to separate into two phases. The organic phase was washed with aqueous acetic acid (pH about 3) to remove excess developer and then concentrated to a syrup which crystallized from ethyl acetate. White solid blocked developer (x) (15.1 g; Compound 15) was obtained.

B) Comparison Dispersion Preparation Using Compound 15

The developer precursor Compound 15 (3 g) was dissolved in 8.3 g cyclohexanone at 60° C. An aqueous gelatin solution (88.7 g) at 50 ° C., containing 32 g of 10% aqueous-deionized gelatin and 4 g of aqueous 10% Alkanol-XC (Du Pont) was stirred with the cyclohexane solution and then passed several times through a Gaulin colloid mill. The resulting emulsified dispersion was then chill set and noodled. The noodles were washed for six hours in cold water to remove the cyclohexanone. The washed and drained noodles were remelted, chill set, and put in cold storage until needed for photographic melt preparation.

C) Solid Particle Dispersion Preparation Using Compound 15

The developer precursor according to formula I, Compound 15, was prepared as a solid particle dispersion by ball-milling according to the following procedure. Compound 15 (3 g), 6 g of 10% (w/w) Alkanol-XC, and water to 50 g total weight were placed in a 100 ml glass jar, along with 50 ml of 1.8 mm diameter zirconia beads, and milled on a roller mill for 5 days. After milling, the suspension was filtered and weighed, and then diluted with aqueous gelatin to yield an aim of 3% precursor and 4% gelatin. The dispersion was chill set and put in cold storage until needed for photographic melt preparation.

D) Coating, Testing, and Processing of Photographic Element

The comparison and invention dispersions were coated in separate single layer coatings for testing. The developer precursor was coated on a reflection support at a level of 1114 mg/m$^2$ along with 1076 mg/m$^2$ of cyan image dye-forming coupler C, Coupler C

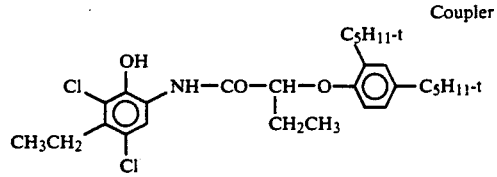

a red sensitized AgCl emulsion at 32 mg/m$^2$ as silver halide, and gelatin at 2690 mg/m$^2$. The coupler was dispersed with dibutylphthalate at a weight ratio of 2:1, using Alkanol-XC as a dispersing aid, in aqueous gelatin, by methods well known in the art. A gelatin overcoat (1076 mg/m$^2$) and hardener (1,1'-[methylenebis(-sulfonyl)]bis-ethene) at 1.5% (w/w) of the total gelatin were coated over the sensitized layers. A first set of coatings was stored below 0° C., a second set of coatings was stored at 100° F./50% relative humidity for 1 week, and a third set of coatings was stored at 120° F./50% relative humidity for 2 weeks. These coatings were then exposed to tungsten light (2850° K.) through a 0-3 density step tablet and processed for image dye formation.

These coatings were developed at 77° F. for 90 seconds by contacting them with an activator solution. This aqueous activator solution was 50 g/l in potassium carbonate, 0.6% (w/w) hydrogen peroxide, 1 g/l in 1-hydroxyethyl-1,1-diphosphonic acid (KODAK Anti-calcium No. 5), 1 g/l in diethylenetriamine pentaacetic acid (KODAK Anti-calcium No. 8), 10 g/l of KODAK PHOTO-FLO 200 solution, and the pH was adjusted to 11. After activator application and development, coatings were placed in an agitated EP-2 blix solution for 1 minute, and then in an aqueous wash bath for several minutes, dipped in PHOTO-FLO 200 solution, and dried. Red status A reflection densities were recorded. The Dmin and Dmax data for these coatings are illustrated in Table IV.

TABLE IV

| Example | Dispersion | Storage | Dmin | Dmax |
|---|---|---|---|---|
| Control 1 | Comparison | Freezer | 0.07 | 0.29 |
| | Solid Particle | Freezer | 0.12 | 0.45 |
| Control 2 | Comparison | 1 Wk 100° F./50% RH | 0.07 | 0.25 |
| | Solid Particle | 1 Wk 100° F./50% RH | 0.14 | 0.46 |
| Control 3 | Comparison | 2 Wk 120° F./50% RH | 0.11 | 0.23 |
| | Solid Particle | 2 Wk 120° F./50% RH | 0.14 | 0.48 |

The ball-milled dispersion used in section C) above was of very fine particle size (less than 0.4 μm in largest dimension). The comparison dispersion used as the control (section B) had particle sizes exceeding 1 μm in largest dimension and gave the appearance of partial crystallization in the dispersion making-coating sequence. The dispersion of this invention clearly gives greater dye forming activity, as evidenced by the 50% to 100% greater Dmax obtained fresh and after storage in comparison to the conventional dispersion prepared by emulsification.

It is to be understood that the foregoing detailed description and specific examples, while indicating preferred embodiments of the present invention, are given by way of illustration and not limitation. Many changes and modifications within the scope of the present invention may be made without departing from the spirit thereof, and the invention includes all such modifications.

What is claimed is:

1. A photographic element comprising
(a) a support,
(b) a silver halide emulsion, and
(c) a dispersion comprising
(i) solid particles of a developer precursor having the structure $$CD-(T)_m-S$$

in which
CD is a silver halide color developer,
T is a timing group,
m is an integer from 0 to 6, and
S is a blocking group,
(ii) a dispersing agent, and
(iii) a vehicle in which said solid particles are insoluble.

2. A photographic element as claimed in claim 1, wherein said dispersion and said silver halide emulsion are in the same layer.

3. A photographic element as claimed in claim 1, wherein said dispersion and said silver halide emulsion are in different layers.

4. A photographic element as claimed in claim 1, wherein CD is an unsubstituted or substituted p-phenylenediamine group or an unsubstituted or substituted p-aminophenol group.

5. A photographic element as claimed in claim 1, wherein S is an acyl group.

6. A photographic element as claimed in claim 5, wherein S is a β-ketoacyl group.

7. A photographic element as claimed in claim 5, wherein S is

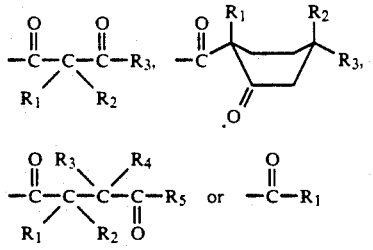

in which $R_1$, $R_2$, $R_3$, $R_4$ and $R_5$ are independently H or an alkyl group having 1 to 20 carbon atoms.

8. A photographic element as claimed in claim 1, wherein at least one of S and T is ballasted.

9. A photographic element as claimed in claim 1, wherein at least one of S and T has a substituent that increases the solubility of said developer precursor.

10. A photographic element as claimed in claim 1, wherein said vehicle is a gelatin coating solution, an aqueous liquid having a pH such that said particles are insoluble therein, an organic solvent in which said particles are insoluble, a monomer or a polymeric binder 11. A photographic element as claimed in claim 10, wherein said vehicle is a gelatin coating solution.

12. A photographic element as claimed in claim 1, wherein said solid particles have a largest dimension of between about 0.001 and 10 μm.

13. A photographic element as claimed in claim 12, wherein said solid particles have a largest dimension of about 0.001 to 1 μm.

14. A photographic element as claimed in claim 1, wherein said development precursor is present in an amount from about 10 to 5000 mg/m².

15. A photographic element as claimed in claim 1, further comprising a dye-forming coupler associated with said silver halide emulsion.

16. A dispersion comprising
(i) solid particles of a developer precursor having the structure $$CD-(T)_m-S$$

in which
CD is a silver halide color developer,
T is a timing group,
m is an integer from 0 to 6, and
S is a blocking group,
(ii) a dispersing agent, and
(iii) a vehicle in which said solid particles are insoluble.

17. A dispersion as claimed in claim 16, wherein CD is a p-phenylenediamine group or a p-aminophenol group.

18. A dispersion as claimed in claim 16, wherein S is an acyl group.

19. A dispersion as claimed in claim 18, wherein S is a β-ketoacyl group.

20. A dispersion as claimed in claim 18, wherein S is

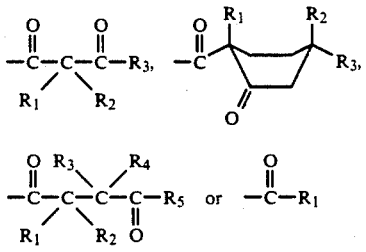

in which $R_1$, $R_2$, $R_3$, $R_4$ and $R_5$ are independently H or an alkyl group having 1 to 20 carbon atoms.

21. A dispersion as claimed in claim 16, wherein at least one of S and T is ballasted.

22. A dispersion as claimed in claim 16, wherein at least one of S and T has a substituent that increases the solubility of said developer precursor.

23. A dispersion as claimed in claim 16, wherein said vehicle is a gelatin coating solution, an aqueous liquid having a pH such that said particles are insoluble therein, an organic solvent in which said particles are insoluble, a monomer or a polymeric binder.

24. A dispersion as claimed in claim 23, wherein said vehicle is a gelatin coating solution.

25. A dispersion as claimed in claim 16, wherein said solid particles have a largest dimension of between about 0.001 and 10 μm.

26. A dispersion as claimed in claim 25, wherein said solid particles have a largest dimension of about 0.001 to 1 μm.

27. A multicolor photographic element comprising a support bearing a cyan dye image-forming unit comprising at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, a yellow dye image-forming unit comprising at least one blue-sensitive silver halide emulsion layer having associated therewith at least one yellow dye-forming coupler, and a dispersion as claimed in claim 16, said dispersion being accessible by diffusion to said silver halide emulsion layers.

28. A multicolor photographic element as claimed in claim 27, wherein said dispersion and said cyan, magenta and yellow image-forming units are in separate layers.

29. A process for developing an image in a photographic element comprising a support, a silver halide emulsion containing an imagewise distribution of developable silver halide grains, and a dispersion comprising (i) solid particles of a developer precursor having the structure $$CD-(T)_m-S$$

in which

CD is a silver halide color developer,

T is a timing group, m is an integer from 0 to 6, and

S is a blocking group, (ii) a dispersing agent, and (iii) a vehicle in which said solid particles are insoluble, said process comprising the step of contacting said element with a processing solution comprising a nucleophile at a pH sufficient for said solid particles of said precursor to become soluble.

30. A process as claimed in claim 29, wherein said pH is between about 9 and 14.

31. A process as claimed in claim 29, wherein S is an acyl group.

32. A process as claimed in claim 31, wherein S is a $\beta$-ketoacyl group and said nucleophile is a dinucleophile.

33. A process for incorporating a developer precursor in a photographic element which comprises the steps of dispersing, in the presence of a dispersing agent, solid particles of a developer precursor having the structure $$CD-(T)_m-S$$

in which

CD is a silver halide color developer,

T is a timing group, m is an integer from 0 to 6, and

S is a blocking group, in a vehicle in which said solid particles are insoluble to produce a dispersion, and incorporating said dispersion in said photographic element.

* * * * *